US005137436A

United States Patent [19]

Vogel

[11] Patent Number: 5,137,436

[45] Date of Patent: Aug. 11, 1992

[54] DEVICE FOR THE GENERATION OF AUXILIARY PRESSURE

[75] Inventor: Guenther Vogel, Frankfurt am Main, Fed. Rep. of Germany

[73] Assignee: Alfred Teves GmbH, Frankfurt am Main, Fed. Rep. of Germany

[21] Appl. No.: 509,935

[22] Filed: Apr. 16, 1990

[30] Foreign Application Priority Data

Apr. 22, 1989 [DE] Fed. Rep. of Germany ..... 3913351

[51] Int. Cl.[5] ..... F04B 17/00

[52] U.S. Cl. ..... 417/404; 91/346; 137/625.27

[58] Field of Search ..... 91/346; 417/403, 404; 137/625.27

[56] References Cited

U.S. PATENT DOCUMENTS

| | | | |
|---|---|---|---|
| 21,155 | 8/1858 | Stevens | 91/346 |
| 1,488,171 | 3/1924 | Savidge | 417/404 |
| 1,893,464 | 1/1933 | Barks | 91/346 X |
| 1,999,881 | 4/1935 | Lowe | 417/403 |
| 2,298,106 | 10/1942 | Carlson | 91/346 X |
| 3,548,717 | 12/1970 | Passaggio | 91/346 X |
| 3,608,587 | 9/1971 | Zbell | 137/625.27 X |
| 4,166,411 | 9/1979 | Bron | 91/346 X |

FOREIGN PATENT DOCUMENTS

| | | |
|---|---|---|
| 0061706 | 10/1982 | European Pat. Off. . |
| 3032430 | 3/1982 | Fed. Rep. of Germany . |
| 3234182 | 3/1984 | Fed. Rep. of Germany . |
| 1162157 | 9/1958 | France . |

*Primary Examiner*—Robert G. Nilson

*Attorney, Agent, or Firm*—Robert P. Seitter; J. Gordon Lewis

[57] ABSTRACT

This invention relates to a device for the generation of auxiliary pressure, and has control valves (2) arranged in a control housing (1) of a control unit. The control valves (2), depending on their position, actuate several control channels (4) leading into severan control pressure chambers (3) so that, depending on the position of the control valves (2), communication can be established between an energy source (5) and s spring-loaded servo piston (6) which, via an adjoining working cylinder (7) sealed by the servo piston (6), delivers a medium of low pressure level to an energy level of high pressure by means of a pressure piston (8), with the servo piston (6) having elastic means (11) which influences a change-over point of the control valves (2) and which, for the purpose of switching the control valves (2), can be clamped in position between a servo element (9) connected on the servo piston (6) and control rod (10) engaging the control unit. The device provides simple, operationally reliable, actuation of the control valves (2). The device of the present invention is particularly useful for automotive vehicle applications.

16 Claims, 1 Drawing Sheet

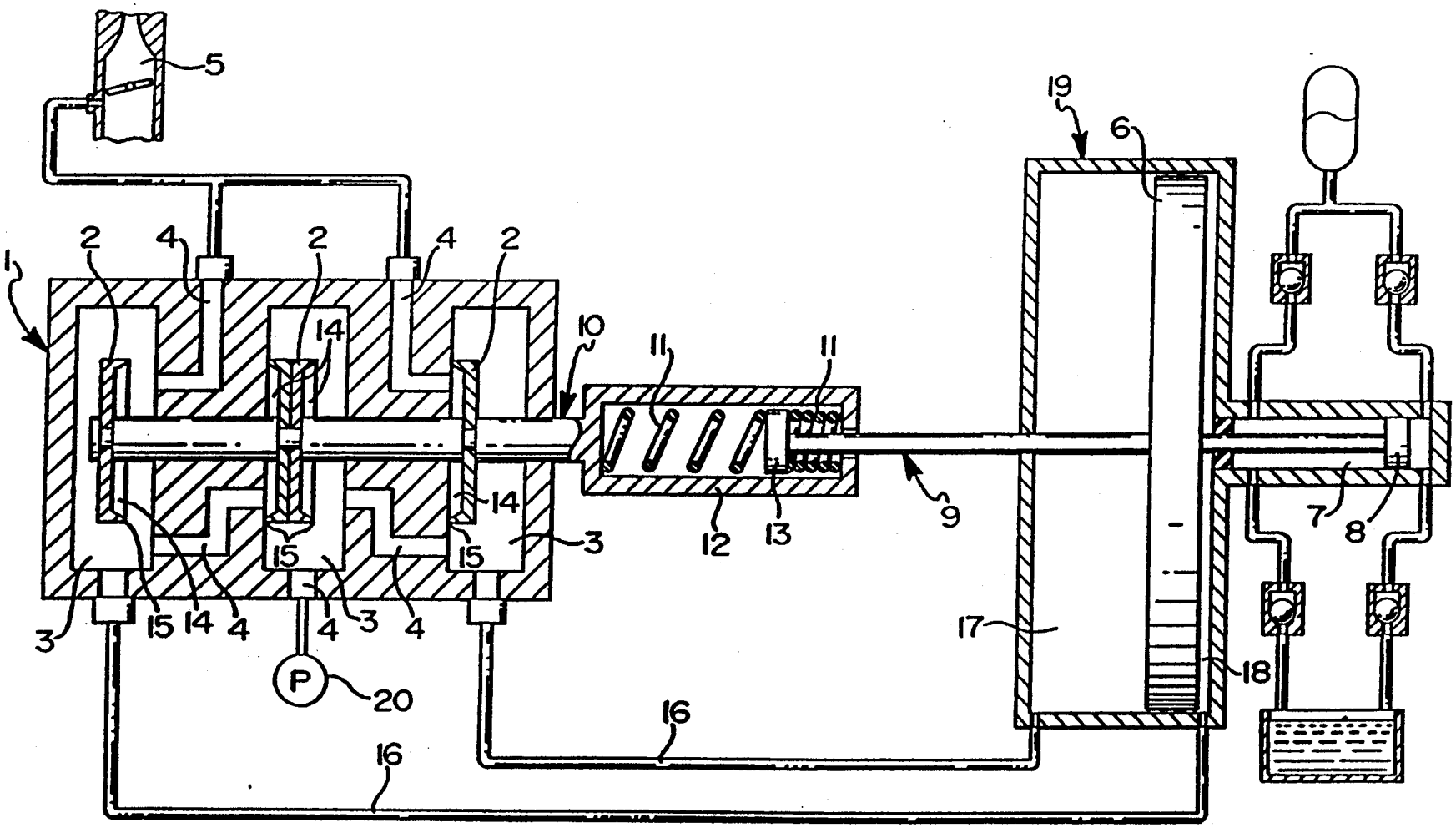
1
2
3
4
5
6
7
8
9
10
11
12
13
14
15
16
17
18
19
20
P

DEVICE FOR THE GENERATION OF AUXILIARY PRESSURE

BACKGROUND OF THE INVENTION

1. Field of the Invention

This invention is generally directed to a device for the generation of auxiliary pressure, particularly for automotive vehicles.

2. Description of the Related Art

Such a device is generally known from German Published Patent Application (DE-OS) No. 32 34 182. The known device provides reciprocating movement of a hydraulically actuated differential piston for driving a pump piston which delivers a pressure medium from a tank to a consumer. To this end, a reversing valve required for cyclic reversal is hydraulically or pneumatically actuated via the differential piston so that the atmospheric pressure, or the vacuum of a vacuum source, is active at the differential piston to stimulate the oscillating pumping movement of the differential piston.

The described design of the differential piston in the known device as a control unit for the hydraulic or pneumatic actuation of the reversing valve, has the disadvantage of a decidedly expensive and intricate construction because of the requirement of a reversing valve arranged indirectly (or possibly even separately) with respect to a sleeve-shaped differential piston provided with recesses. Also, the referenced control unit is disadvantageous because of the requirement of a line system for automatically activating the reversing valve. Further, there is the danger of malfunctions such as even small leakages resulting from known problems of manufacture and of sealing, if, during operation of the device, the differential piston, or rather the actuating piston, is of the control slide type.

The cost factor, in particular, implies considerable disadvantages in the known system. Further yet, there exists the danger that the differential piston will remain stationary in a position between the two dead center positions in the event that control currents are unsteady, thereby preventing any switching of the control valve.

Accordingly, it is an object of this invention to provide an improved device for driving an auxiliary pressure generator of the generally known type described above, in which the most simple constructional means are employed for increasing reliability independently of disadvantageous material and constructional phenomena resultant from manufacture and use.

It is a further object of the invention to simultaneously minimize the cost of manufacturing of the device.

SUMMARY OF THE INVENTION

In accordance with the present invention, a device is provided for the generation of auxiliary pressure which, owing to its inventive combination and to the use of the most simple mechanical means, enables reliable operation and economical use of available energy sources.

In order to achieve ideal or optimum sealing of control channels of control valves of the device, an advantageous further development of the subject matter of this invention includes the construction of the control valves as seat valves which, via narrow annular seat surfaces formed on the front faces by means of recesses, separate control chambers at the control channels in a pressure-medium-leak-proof way.

For the purpose of increasing the capacity of the device, both front faces of the pump piston arranged in the working cylinder are acted on by a pressure medium to ensure a considerable increased auxiliary pressure resulting from the double-acting piston.

Further characteristics, advantages and applications of the invention will become evident from the following description of the preferred embodiment.

BRIEF DESCRIPTION OF THE DRAWING

The single drawing figure illustrates a longitudinal sectional view of a preferred embodiment of a device for generating auxiliary pressure in accordance with the present invention.

DESCRIPTION OF THE PREFERRED EMBODIMENT

The drawing illustrates a longitudinal section of a schematically sketched example of a preferred embodiment of the inventive device for auxiliary pressure generation. This device includes a control unit designed as a change-over valve. A control rod 10 penetrates the control unit coaxially in a control housing 1. Control rod 10 respectively opens and closes the control unit via control channels 4 connected to and in communication with control valves 2. Control valves 2 are carried on the control rod 10 and arranged between three control pressure chambers 3 in the control housing 1. Control valves 2 are configured as seat valves defining recesses 14 closed by radially annular sealing surfaces 15 selectively engaging control housing 1.

Depending on the position of a control valve 2 which, in each case, is active in a control pressure chamber 3, the control pressure chambers 3 are preferably pressurized by atmospheric pressure or by a vacuum source. Via two connection lines 16, the control pressure chambers 3 connect a servo cylinder 19 with a vacuum source and an atmospheric pressure source. A servo piston 6 subdivides the servo cylinder 19 into two working chambers 17 and 18, and an adjoining working cylinder 7 is sealable by the servo piston 6.

Under the action of pneumatic moving force at the servo piston 6, the control rod 10 adopts a defined position in the control unit in dependence on the coil bound length in a control head 12, which length defines a change-over point. Springs 11 arranged as elastic means in the control head 12 are designed to ensure that, when the coil bound length is reached, the product of the spring rigidity and the travel of the spring system will be slightly less than the pneumatic pressure force which, via the control rod 10, acts in the opposite direction on the control valves 2 of the control unit.

Thus, the change-over point for reversing the direction of movement of the control rod 10 will be enabled only by the direct force transmission from a servo element 9 coupled to the servo piston 6 to the control head 12 via, a piston shaped portion 13 and the spring 11 shown on the right-hand side of the drawing which then will be acting as a rigid cylinder.

The above arrangement enables a very precise adjustment of the change-over point since the spring tension as a function of the spring length has a considerably greater tolerance zone width than the coil bound length has. The accumulated capacity of the spring serves to safely overcome the switching travel of the control valves.

The rigid connection of a pressure piston 8 to the servo element 9 causes the servo piston 6 to move in dependence on the pneumatic moving force, in each case one of the two springs supported within the control head 12 being compressible until reaching the coil bound length defining the change-over point so that, owing to the clamping arrangement of the springs between the control head 12 and the servo element 9, a reaction force can be transmitted to the control head. This reaction force results in a displacement of the control rod 10 and, hence, via the valves 2 in the control unit, to a reversal of the differential pressure acting on the servo piston 6. As the pressurization and the resulting direction of movement of the servo piston 6 in the servo cylinder 19 is reversed, the double-acting pump piston 8 within the working cylinder 7 also experiences a reversal in its direction of movement.

In accordance with the device specifically disclosed in the drawing, the following description of the mode of operation refers to a position of the control rod 10 wherein, via the open control valve 2, preferably a vacuum tapped from the intake manifold of a petrol engine, used as a first energy source 5, is active in the control pressure chamber 3, illustrated on the left in the drawing, and in the first connection line 16 of the servo cylinder 19 while, via an open control channel 4, and a second energy source 20, atmospheric pressure streams from the control pressure chamber 3 in the middle to the control pressure chamber 3, illustrated on the right in the drawing, and may propagate into the second connection line 16. Consequently, a differential pressure exists in the working chambers 17 and 18 separated by the servo piston 6, and the differential pressure displaces the servo element 9 together with the adjoined pump piston 8 into the described position, while the springs' prestressing forces in the control head 12, which are opposed to each other, are simultaneously increased or reduced, respectively.

When the coil bound length is reached, as is the case with the spring shown on the right in the drawing, the force of the servo piston 6 acts directly on the control rod 10 and the differential pressure force will prevail at the control valves of the control pressure chambers 3 in the middle and on the right so that there will be a displacement of the control rod 10 in the opposite direction. During this action, the spring between the servo element 9 and the control head 12 which is prestressed to its bound length, will exert a reaction force which will be sufficient to bridge the lost travel of the control valves 2 up to their stops on the opposite surfaces of the control pressure chambers 3.

Consequently, the reversal of the direction of movement will result in a change of the opening and closing functions of the control channels so that, via the two connection lines 16, the servo piston 6 also will experience a pressurization effect in the opposite direction and acting in opposition to the second spring, nearest to the control valves 2, and prestressing said spring according to the valve reversal point and until the coil bound length is reached. Subsequently, a new operating cycle will commence as already described. Owing to the oscillating mode of operation, a double-acting piston 8 is suitable for increasing the delivery. A double acting piston, via non-return valves will, for example, supply a medium from a storage reservoir to a pressure accumulator.

According to the above description of the invention, the device operates with a pneumatic energy supply. It is, however, equally within the scope of the invention to employ a hydraulic energy supplier, with the required pressure difference being safeguarded.

As a result of the design of the device described above for auxiliary pressure generation, it is possible to dispense with conventional electromagnetically controlled valves and it is possible to restrict the known operational means to a minimum. Available energy sources are economically used by the device, as for example, the use of an existing atmospheric pressure source, in conjunction with a vacuum source of an internal combustion engine with governing control, where the device is used for automotive applications. Accordingly, the device disclosed herein is particularly useful for automotive vehicle applications, but those skilled in the art will recognize other applications for which the device may be advantageously employed.

A further advantage of the device discussed above is the uncomplicated actuation of the control valves, this actuation being advantageously resulting from the integration of a spring package between a control rod and a servo element. It is therefore possible to avoid considerable malfunctions and expensive and intricate operational mechanisms.

What is claimed is:

1. A device for the generation of auxiliary pressure, said device including a plurality of control valves arranged in a control housing of a control unit, said control valves, in dependence on their position, respectively adapted to control fluid flow through a plurality of control channels entering into a plurality of control pressure chambers so that, in dependence on the position of the control valves, communication is established between an energy source and a servo piston which, via an adjoining working cylinder, delivers a pressure medium by means of a pump piston, characterized in that the servo piston includes elastic means which influence a change-over point of the control valves and which, for the purpose of switching the control valves is positioned between a servo element arranged on the servo piston and a control rod engaging the control unit, wherein the elastic means is formed by two helical springs arranged in series, in each case a first spring end of the springs contacting the servo element while the second spring end in each case is supportingly held within a control head which is designed as a hollow cylinder and is provided on the control rod.

2. A device set forth in claim 1 characterized in that a hollow cylinder control head is provided on said control rod of and that the servo element is guided axially by a shaft engaging an opening in the hollow cylinder control head and is guided radially via a piston-shaped portion.

3. A device for the generation of auxiliary pressure as set forth in claim 1 characterized in that, if one of the springs is compressed completely, the spring pre-tension is greater than, and the direction of the spring pre-tension is opposed to, control pressure forces acting on the control valves.

4. A device for the generation of auxiliary pressure as set forth in claim 3, characterized in that each of said control valves and said servo piston have a front face, and that the front faces of the control valves to which pressure is applied by and energy source are smaller than the front face of the servo piston to which differential pressure is applied by said same energy source.

5. A device for the generation of auxiliary pressure, said device including a plurality of control valves arranged in control housing of a control unit, said control valves, in dependence on their position, respectively adapted to control fluid flow through a plurality of control channels entering into a plurality of control pressure chambers so that, in dependence on the position of the control valves, communication is established between an energy source and a servo piston which, via an adjoining working cylinder, delivers a pressure medium by means of a pump piston, characterized in that the servo piston includes elastic means which influence a change-over point of the control valves and which, for the purpose of switching the control valves, is positioned between a servo element arranged on the servo piston and a control rod engaging the control unit, wherein a control head is provided on said control rod and the servo element is guided axially by a shaft engaging an opening in the control head and is guided radially via a piston-shaped portion.

6. A device for the generation of auxiliary pressure as set forth in claim 5 characterized in that, in dependence on the axial movement of the servo element, prestressing forces of the elastic means of the springs arranged in series relate reciprocally proportionally to each other.

7. The device of claim 5 wherein said seat valves are circular in shape.

8. A device for the generation of auxiliary pressure as set forth in claim 5, characterized in that the receses are defined to receive applied pressure propagating through said control channels.

9. A device for the generation of auxiliary pressure, said device including a plurality of control valves arranged in a control housing of a control unit, said control valves, in dependence on their position, respectively adapted to control fluid flow through a plurality of control channels entering into a plurality of control pressure chambers so that, in dependence on the position of the control valves, communication is established between an energy source and a servo piston which, via an adjoining working cylinder, delivers a pressure medium by means of a pump piston, characterized in that the servo piston includes elastic means which influence a change-over point of the control valves and which, for the purpose of switching the control valves, is positioned between a servo element arranged on the servo piston and a control rod engaging the control unit, wherein the control valves are seat valves and the seat valves define recesses closed by radial annular sealing surfaces so as to prevent pressure medium from penetrating.

10. A device for the generation of auxiliary pressure for the automotive vehicles, said device including a plurality of control valves arranged in a control housing of a control unit, said control valves, in dependence on their position, respectively adapted to control fluid flow through a plurality of control channels entering into a plurality of control pressure chambers so that, in dependence on the position of the control valves, communication is established between an energy source and a servo piston which, via an adjoining working cylinder delivers pressure medium by means of pump piston, characterized in that the servo piston includes elastic means which influence a change-over point of the control valves and which, for the purpose of switching the control valves, is positioned between a servo element arranged on the servo piston and a control rod engaging the control unit, wherein the elastic means is formed by two helical springs arranged in series, in each case a first spring end of the springs contacting the servo element while the second spring end in each case is supportingly held within a control head which is designed as a hollow cylinder and is provided on the control rod.

11. A device as set forth in claim 10 characterized in that a hollow cylinder control head is provided on said control rod and that the servo element is guided axially by a shaft engaging an opening in the hollow cylinder control head and is guided radially via a piston-shaped portion.

12. A device for the generation of auxiliary pressure as set forth in claim 10 characterized in that, in dependence on the axial movement of the servo element, prestressing forces of thee elastic means of the springs arranged in series relate reciprocally proportionally to each other.

13. A device for the generation of auxiliary pressure as set forth in claim 10 characterized in that the control valves are seat valves and the seat valves define recesses closed by radial annular sealing surfaces so as to prevent pressure medium from penetrating.

14. The device of claim 13 wherein said seat valves are circular in shape.

15. A device for the generation of auxiliary pressure as set forth in claim 13, characterized in that the recesses are defined to receive applied pressure propagating through said control channels.

16. A device for the generation of auxiliary pressure for automotive vehicles, said device including a plurality of control valves arranged in a control housing of a control unit, said control valves, independence on their position, respectively adapted to a control fluid flow through a plurality of control channels entering into a plurality of control pressure chambers so that, in dependence on the position of the control valves, communication is established between an energy source and a servo piston which, via an adjoining working cylinder, delivers a pressure medium by means of a pump piston, characterized in that the servo piston includes elastic means which influence a change-over point of the control valves and which, for the purpose of witching the control valves is positioned between a servo element arranged on the servo piston and a control rod engaging the control unit, wherein a control head is provided on said control rod and that the servo element is guided axially by a shaft engaging an opening in the control head and is guided radially via a piston-shaped portion.

* * * * *